US005566520A

United States Patent [19]

Branitzky

[11] Patent Number: 5,566,520

[45] Date of Patent: Oct. 22, 1996

[54] INTEGRATED PRECAST CONCRETE FORMING SYSTEM

[76] Inventor: Abraham Branitzky, 520 Carriage Dr., West Chicago, Ill. 60185

[21] Appl. No.: 165,018

[22] Filed: Dec. 9, 1993

[51] Int. Cl.[6] ..... E04C 2/04; E04B 5/04

[52] U.S. Cl. ..... 52/596; 52/602; 52/79.11; 52/252; 52/745.2

[58] Field of Search ..... 52/600, 601, 602, 52/79.11, 250, 251, 252, 259, 260, 293.1, 596, 745.2

[56] References Cited

U.S. PATENT DOCUMENTS

| | | | |
|---|---|---|---|
| 2,335,433 | 11/1943 | Minck | 52/274 X |
| 3,564,791 | 2/1971 | Arp | 52/602 X |
| 3,604,177 | 9/1971 | Clyne et al. . | |
| 3,693,304 | 9/1972 | Shell . | |
| 3,999,913 | 12/1976 | Branizky . | |
| 4,019,293 | 4/1977 | Armas | 52/79.11 X |
| 4,045,937 | 9/1977 | Stucky . | |
| 4,137,684 | 2/1979 | Shennan | 52/602 |
| 4,142,340 | 3/1979 | Howard | 52/293.1 X |
| 4,211,043 | 7/1980 | Coday . | |
| 4,342,177 | 8/1982 | Smith . | |
| 4,493,177 | 1/1985 | Grossman . | |
| 4,555,888 | 12/1985 | Goldenberg et al. . | |
| 4,620,404 | 11/1986 | Rizk . | |
| 4,776,556 | 10/1988 | Dingler . | |
| 5,138,813 | 8/1992 | Cooney et al. . | |
| 5,317,848 | 6/1974 | Abbey | 52/630 X |

FOREIGN PATENT DOCUMENTS

| | | | |
|---|---|---|---|
| 3136752 | 4/1983 | Germany | 52/602 |
| 1-247627 | 3/1989 | Japan | E04B 1/24 |
| 0537187 | 6/1941 | United Kingdom | 52/602 |
| 0754046 | 8/1956 | United Kingdom | 52/602 |

OTHER PUBLICATIONS

International Conference of Building Officials Technical Report, Report No. PFC-3602, Jan. 1984.

*Primary Examiner*—Carl D. Friedman
*Assistant Examiner*—Winnie Yip
*Attorney, Agent, or Firm*—Niro, Scavone, Haller & Niro

[57] ABSTRACT

Pre-cast concrete wall modules including a relatively thin, web with inner and outer surfaces and two columns located on opposite sides of the web. Each wall module also includes at least two vertical columns and one horizontal beam extending generally normal to the columns. The columns are each located substantially near an end of the web, and the beam is located substantially near the uppermost portion of the web. The invention also includes a casting bed for forming the wall modules, and the method of forming the wall modules.

14 Claims, 14 Drawing Sheets

INTEGRATED PRECAST CONCRETE FORMING SYSTEM

U.S. Pat. No. 3,999,913 for "Concrete Shaping and Stressing Means," issued Dec. 28, 1976, is hereby incorporated by reference.

BACKGROUND OF THE INVENTION

This invention relates to the construction industry and, more specifically, to the use of pre-cast concrete forms for constructing various structures.

The cost of wood has escalated in recent years and, given environmental concerns, will no doubt continue to do so. Building structures such as homes using pre-cast, tilt-up concrete panels can significantly reduce the initial cost of construction, increase the life of the structure and reduce maintenance cost.

Commercially available pre-cast concrete panels, in a form that might be used to construct the walls or floors of a home, are typically 5–7 inches thick, are difficult to transport due to their weight and size, and can require large, expensive cranes for placement into position. A lighter and integrated pre-cast concrete forming system would have the advantage of improved ease of placement, while maintaining strength, preserving design details, and allowing rapid construction.

As the cost of wood escalates, concrete homes appear attractive. A sandwich blend of concrete and insulation materials makes good sense structurally, economically and thermally, while allowing a low initial cost, low maintenance and durability. Yet, the appearance has to be appealing. Cast-in-place concrete is bulky and, when face mold is used to provide an attractive surface, it is costly as well. Shotcrete (spraying modified concrete on vertical or horizontal surfaces) has a very spartan look.

Tilt-up panels are made under controlled conditions and the face-up surface can be inexpensively finished with rollers to shape an attractive product. Such panels can be fabricated and stored in the factory, ready for fast delivery and fast erection. Homes can be assembled rapidly, allowing a savings on interest paid during the construction interim. Panel construction requires cranes, which are expensive. The expense can be justified, however, when several homes are built, splitting the cost of the crane, or when the panels are light and a hydraulic crane can be used.

SUMMARY OF THE INVENTION

The present invention preserves the advantages of prior art pre-cast concrete wall forms. In addition, it provides new advantages not found in currently available pre-cast concrete wall forms, and overcomes many of the disadvantages of such currently available rigid, non-expanding forms.

The present invention is directed to an integrated pre-cast concrete wall modular system for use in assembling a structure. The wall module of the present invention is lighter and cheaper, yet stronger for its size, than commercially available pre-cast wall units. The wall module of the present invention can also be manufactured in virtually any commercially useable sizes; most commercially available panels are only provided in certain sizes, such as 8'×8', 8'×16', etc. This wall module is also designed to provide convenient locations for attaching insulation to the wall module.

The wall module of the present invention includes a web having inner and outer web surfaces defining a web thickness. The web also has opposing lateral edges, and opposing top and bottom edges. At least two columns are also provided, with each column being positioned substantially near one of the lateral edges of the web. Each column has inner and outer column surfaces, and a thickness greater than the web thickness. The inner column surface is substantially coplanar with the inner web surface, and the outer column surface extends beyond the outer web surface. A beam is positioned substantially at the top edge of the web and has inner and outer beam surfaces. The inner beam surface extends beyond the inner web surface, and the outer beam surface is substantially coplanar with the outer web surface.

The present invention is also directed to a method for forming these pre-cast concrete wall modules or panels. The method includes the step of placing a concrete mixture into forms positioned on a casting bed. The casting bed includes edge forms suitable for shaping the wall modules. Reinforcing members are located in the concrete mixture so as to provide structural balance and minimize the bending of the wall module during the erecting step, such that the elastic stresses of the module are not exceeding during maximum loading conditions (i.e., during tilt-up of the modules). Connecting members, such as coil ties, coil bolts and sleeves, hold the forms in place and become an integral part of the cast panel. Following erection, adjacent wall modules are connected to each other by the use of mating connecting members. Individual wall modules can also be connected to a foundation, basement walls, a second floor, or a roof, using similar connecting members.

Finally, the present invention is also directed to the casting bed used to make these wall modules. The casting bed includes a generally planar slab with a step down. A primary framing member is used to form the web and beam, and covers a portion of the step. At least two column framing members are used to form the columns. The column framing members are separated by a coil tie, rigid sleeve, or similar device; they rest on the primary framing member, and extend generally normal to the step. In the case of columns, each of the column framing members are located substantially near an end of the web. In addition, column framing members can be located at different positions along the lengthwise direction of the primary framing member.

BRIEF DESCRIPTION OF THE DRAWINGS

The novel features which are characteristic of the present invention are set forth in the appended claims. However, the preferred embodiments of the invention, together with further objects and attendant advantages, will be best understood by reference to the following detailed description taken in connection with the accompanying drawings in which:

DETAILED DESCRIPTION OF THE PREFERRED EMBODIMENT

Figure 1:
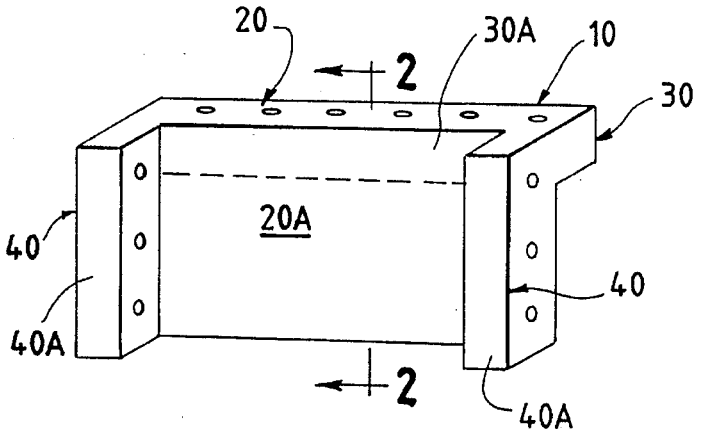
FIG. 1 is a front perspective view of a pre-cast concrete wall module of the present invention.
Figure 2:
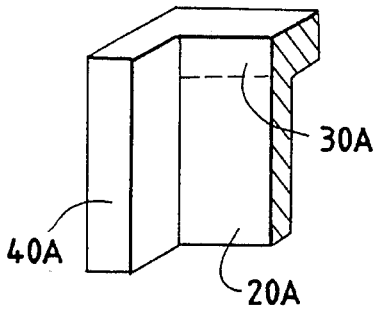
FIG. 2 is a cross-sectional view taken along section line 2—2 of FIG. 1.

The prefabricated, pre-cast concrete wall module of the present invention is shown in FIG. 1, and generally identified as 10. Prefabricated wall module 10 might, for example, form a portion of the walls of a home and includes a relatively thin concrete web portion 20, a horizontally extending concrete beam 30, and two vertically extending concrete columns 40.

Figure 3:
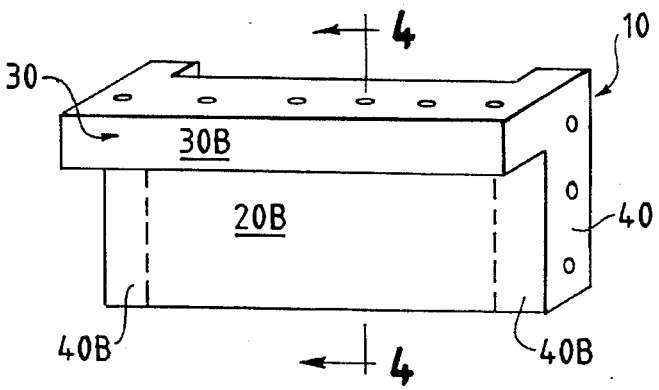
FIG. 3 is a rear perspective view of the pre-cast concrete wall module of the present invention.
Figure 4:
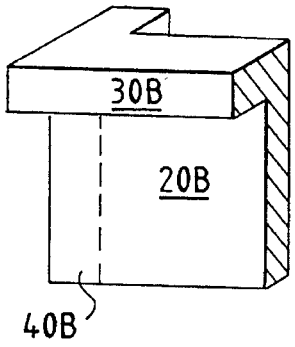
FIG. 4 is a cross-sectional view taken along section line 3—3 of FIG. 3.

As used herein to define the surfaces of wall module 10, "outer" is defined as the surface which is adjacent or closest to the building exterior, while "inner" is defined as the surface adjacent to or closest to the building interior. For example, the outer surfaces 40A of the two columns 40 of each wall module 10 are located on the same side as the outer surface 20A of web 20. Beam 30 includes outer beam surface 30A and inner beam surface 30B, and is located above and outside the living space of the building interior, and on the same side as the inner surface 20B (see FIG. 3) of web 20 and the inner column surface 40B. (It will be understood, as shown in FIGS. 1 and 3, that inner column surface 40B forms a portion of inner web surface 20B, and that outer beam surface 30A forms a portion of outer web surface 20A.)

As will be more specifically described below, columns 40 and beams 30 each contain reinforcing steel bars ("rebar") to provide balanced strength, while wall module 10 as a whole also includes wire mesh to provide additional strength and integrity, particularly to the web.

As will be appreciated by the foregoing description, beam 30 and columns 40 serve to brace and restrain the thin wall (i.e., web 20) to resist bending. The beam also provides rigidity to the web so that the web does not fold, fail or crack during the lifting operation. The beam additionally provides a ready-made nailer for conventional interior finishing, such as by utilizing the attached wooden frame members shown in FIG. 7.

Since the web is restrained with the use of Columns and a beam as described, a thinner web can be used (e.g., as thin as between 2 and ½ to 3 inches). Preferably, an L/r ratio ("slenderness ratio") of less than 120 (the slenderness ratio of concrete) is used. Here, "L" is the height of a wall module, while "r" is the radius of gyration, the computation of which is well known to those possessing structural design knowledge.

Figure 8:
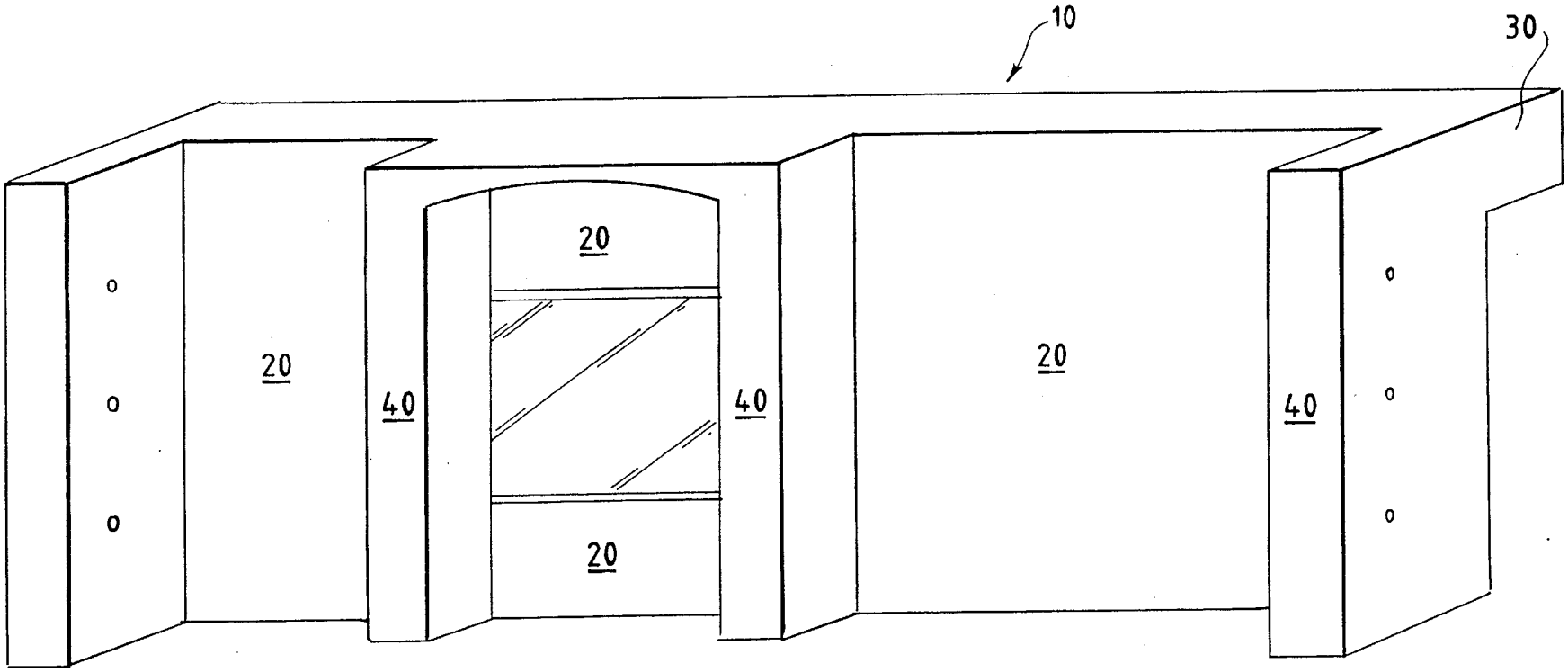
FIG. 8 is a front perspective view of another preferred embodiment of the present invention, a modified wall module 10, in which intermediate columns of different size from the columns are shown connected by the beam.

As shown in FIG. 8, additional columns of varying sizes, running in a parallel fashion to the two columns, can be used as needed, given the length of the wall and other structural considerations. In addition, as also shown, the beam can be cast (for example) so as to connect the innermost edges of the intermediate columns, as well. While columns and beams which are generally square-shaped are shown, the columns and beams could be generally rectangular or cylindrical in shape as well. As shown in FIG. 8, additional shapes might be used, and the columns or beams might be tapered as well, depending on the required design and the aesthetics involved.

Figure 5:
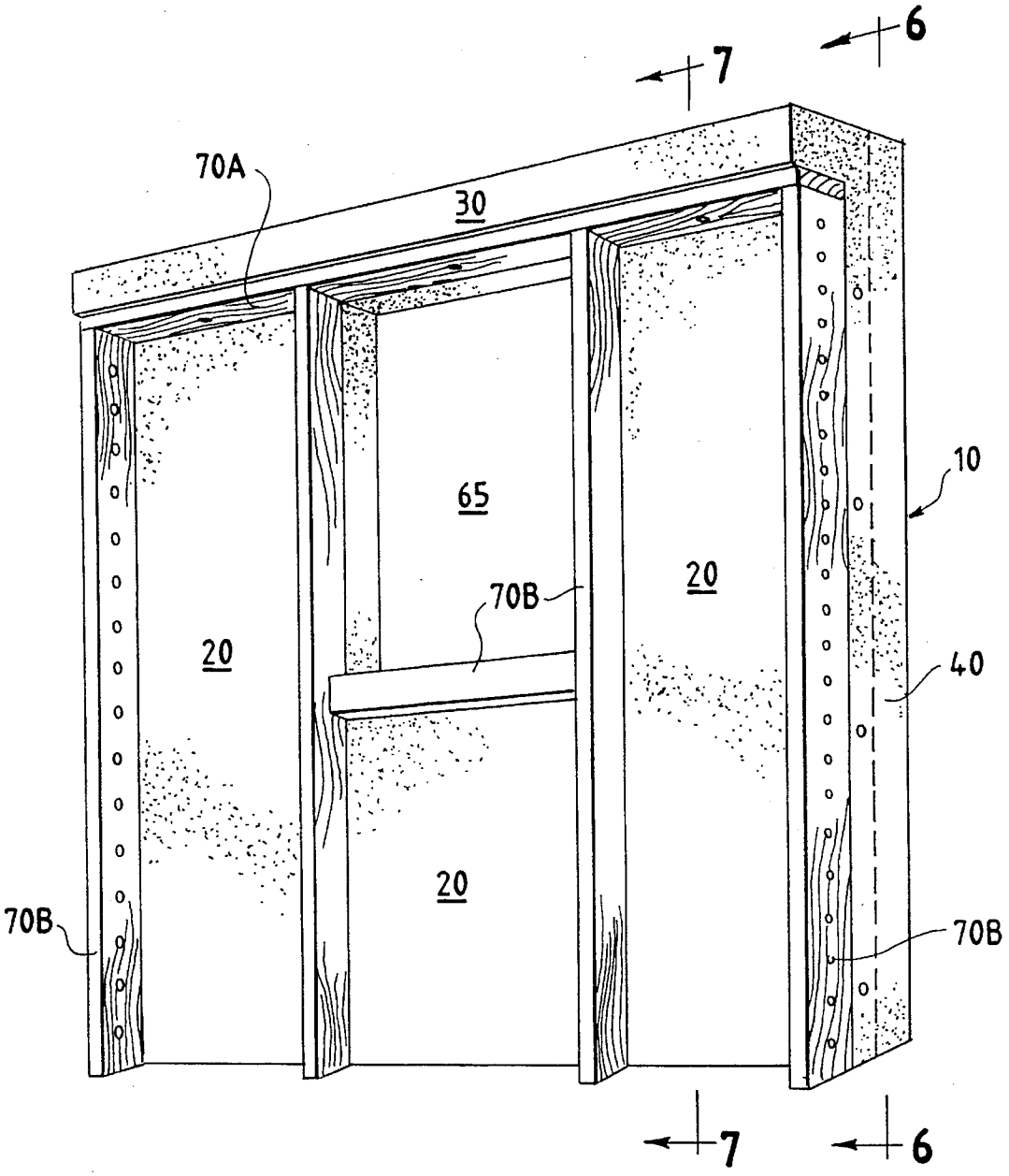
FIG. 5 is a rear perspective view of the pre-cast concrete wall module, with attached wooden studs conventionally used to attach insulation and drywall.

Turning to FIG. 5, a portion of the web can be blocked during casting, such as with wood studs 70B, to provide spaces within wall module 10 for doors or windows, where desired, as indicated by window 65. Header 70A is attached during forming on the adjustable casting bed (as explained further below) and wood studs 70B can be attached to wall module 10 after casting and erection on the job site.

Figure 7:
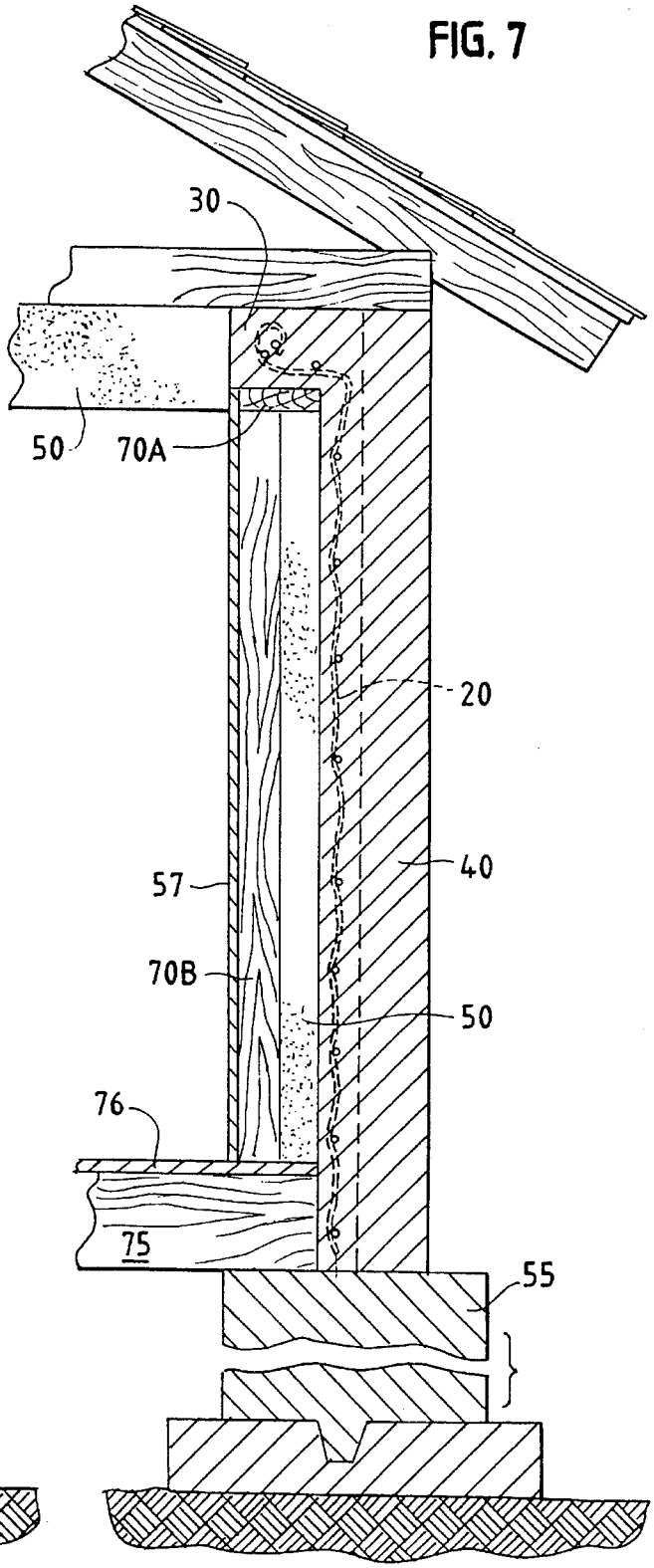
FIG. 7 is a side cross-sectional view of FIG. 5 taken along the section line 7—7; in this view, portions of a roof truss and foundation are shown, as well.

As shown in FIG. 7, beam 30 extends a sufficient distance past the inner surface of the web (e.g., 10–12 inches) to insure that the web (whose outer surface is exposed to the environment) can be properly insulated. The lower portion of wall module 10 rests on concrete foundation 55; floor joist 75, in turn, rests on foundation 55. Beam 30, which projects over the web, allows the framed wall module 10 to be covered with insulation 50 (which can be glued to the inner surface of web 20). Dry wall 57 rests on floor 76 and can then be attached to vertically extending wooden (e.g., "2×4" or "2×6") wall studs 70B, and horizontally extending wood stud ("header") 70A.

"Framed" or "framing" as used herein refers to the process of constructing wooden or steel forms to contain the concrete matrix; after initial curing, the forms are removed, leaving the shaped and hardened concrete.

The web height (not including the beam) is preferably at least 8 feet, which is the typical room height in a house. This will insure that beam 30 is not contained within the living space of the room (as shown in FIG. 7). This design is preferred since concrete is not an efficient insulator. While it will be appreciated that wall modules 10 of varying sizes can be used, one preferred embodiment has the following dimensions: (A) a module height of 9 feet; (B) a module length of 24 feet; (C) a web thickness of between 2.5" and 3"; and (D) square columns and beams with dimensions of 10"×10".

Figure 9:
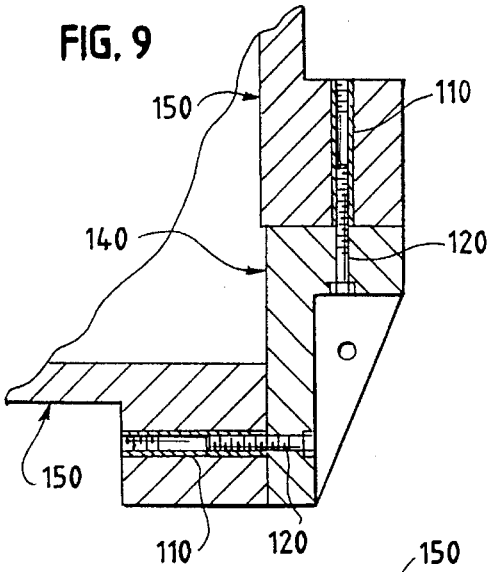
FIG. 9 is a planar view of an L-shaped corner section embodiment of the present invention, showing the corner section attached to adjacent wall modules by recessed bolts and coil ties.
Figure 10:
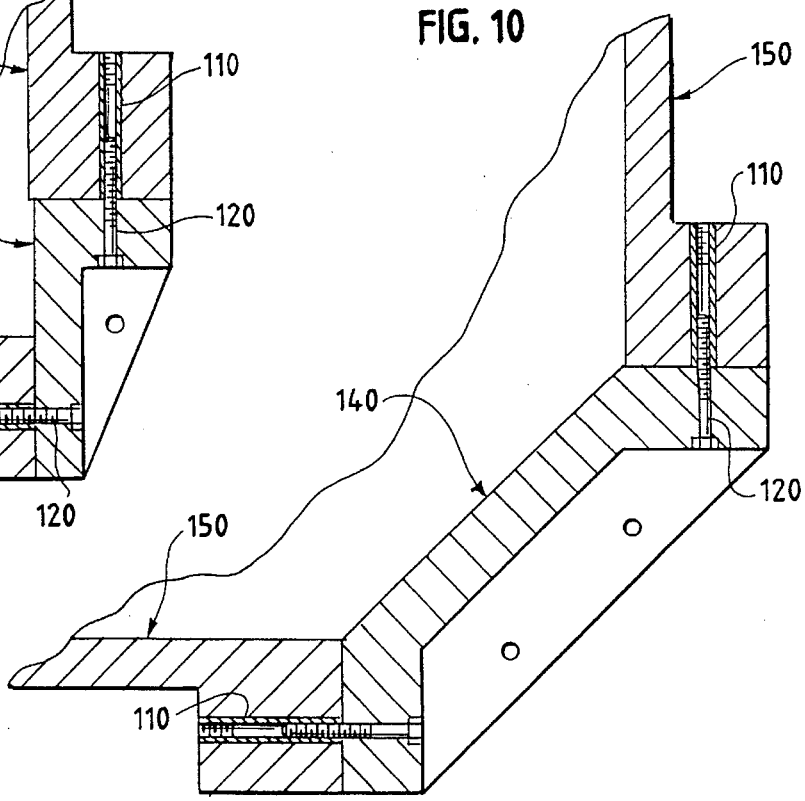
FIG. 10 is a planar view similar to FIG. 10 of an alternative (U-shaped) corner section embodiment.
Figure 13:
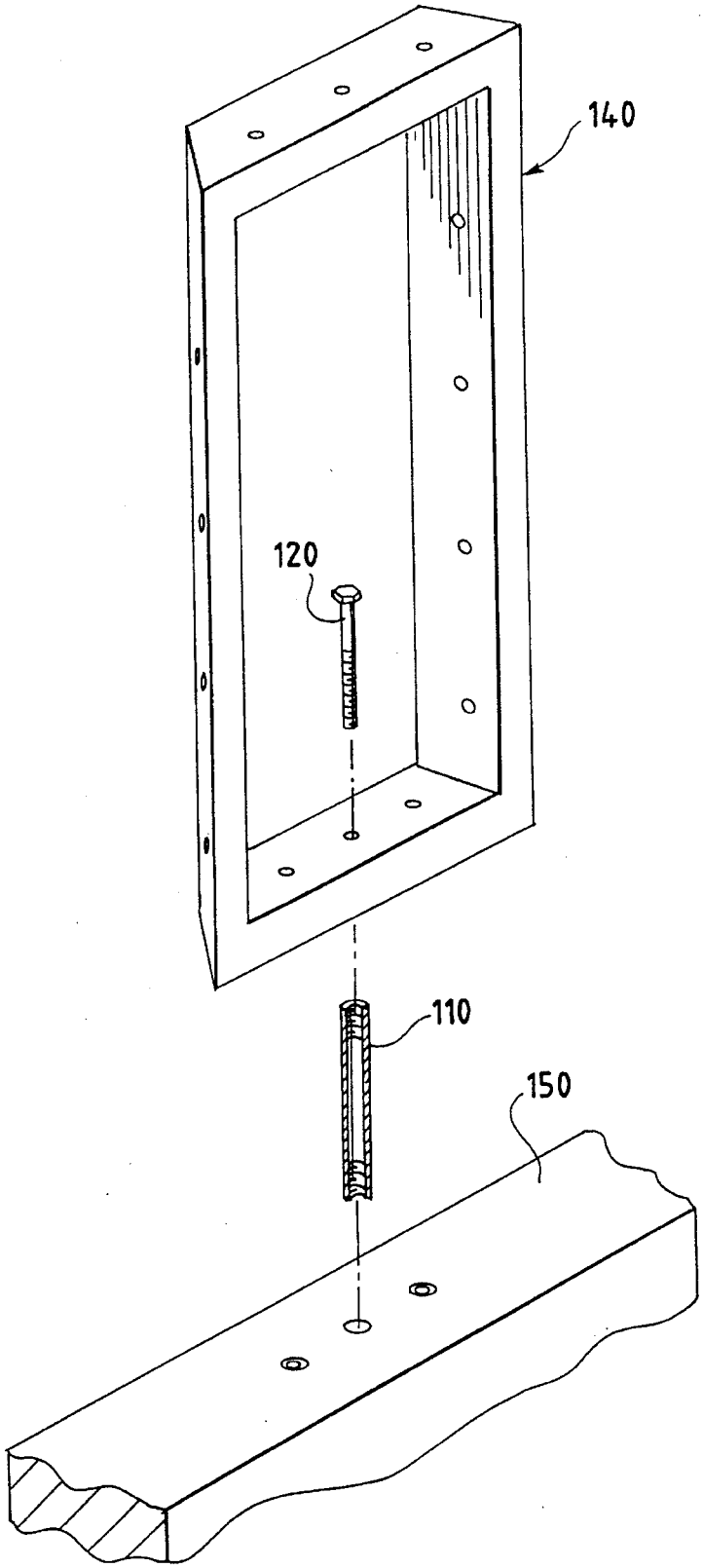
FIG. 13 is a perspective view of another corner section, illustrating attachment by coil ties and coil bolts to a foundation or basement wall.

The arrangement described above and shown in FIG. 7 allows the beam to be directly connected to the roof trusses and carry the roof load. Alternatively, beam 30 of wall module 10 can be directly connected to a second floor utilizing identical wall modules. As shown in the drawings, apertures are embedded in the the columns or beams, prior to curing, to facilitate connection by any expedient means to another floor, or to a roof. Referring now to FIGS. 9, 10 and 13, when the concrete cures, coil ties 110 become an integral part of the structure, and the corresponding use of coil bolts 120 allows column-to-column (for the connection of adjacent wall modules), roof-to-beam, beam-to-floor, etc., connections.

The web, columns and beam of each wall module form a single integrated (i.e., one-piece) slab of pre-cast concrete. Wire mesh and rebars are placed in wall module 10 prior to casting to provide a reinforced pre-cast structure, and to further provide an integrated, unitary structure.

Figure 6:
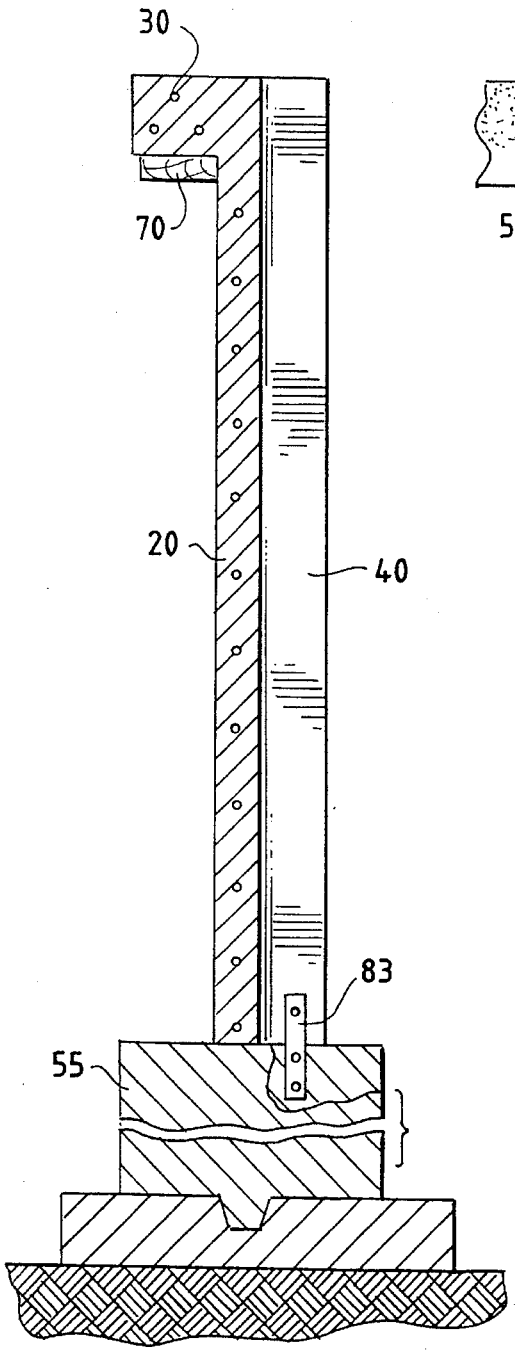
FIG. 6 is an end cross-sectional view of FIG. 5 taken along the section line 6—6.

Each wall module 10 can also be connected to a foundation or basement wall (see, e.g., FIGS. 7, 13). The connection of column 40 to foundation 55 can include a bolted steel plate 83 (see FIG. 6), which can be recessed between adjacent columns. Rubber diaphragms are used to cover and seal the wall to the foundation or basement walls.

Steel coil ties 110 or rigid sleeves (not shown), as well as straight or flared coil loops or anchors, (not shown) can be placed between adjacent columns, forming a narrow receptacle useful for attaching the columns by any expedient connectors, such as bolts. The ends of adjacent beams of adjacent wall modules are attached in a similar manner, employing separating members and connectors. Other hardware components, known to those of skill in the art, can be utilized by tilt-up panel manufacturers. As shown in FIGS. 9–10, apertures of sufficient size can be provided in the columns so that the bolts 120 are recessed into the structure.

Figure 11:
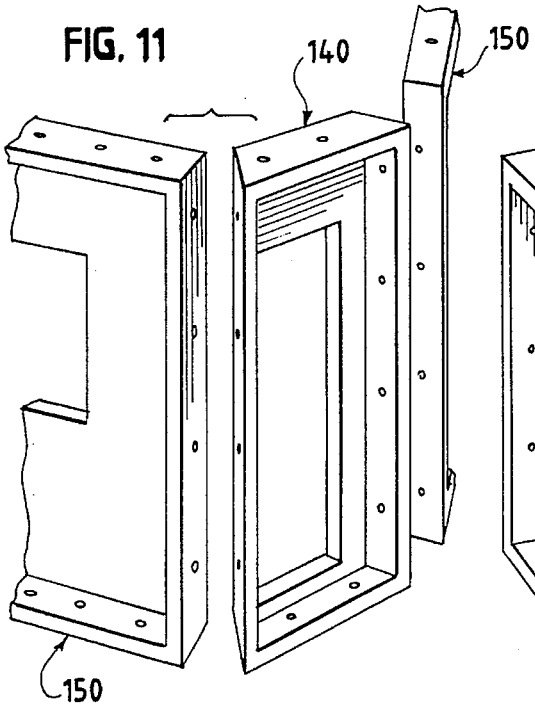
FIG. 11 is a perspective view of an alternative corner section, which includes a space for a door (bolt and coil tie connections not shown)
Figure 12:
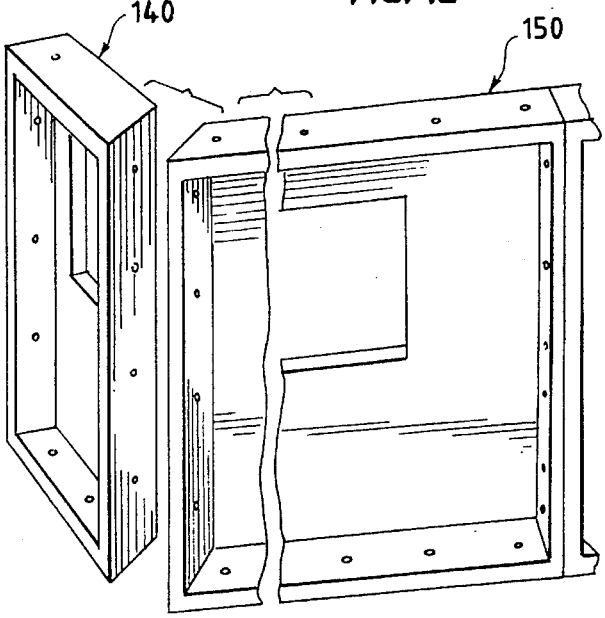
FIG. 12 is a perspective view similar to FIG. 11 of another corner section, which includes a space for a window.
Figure 21:
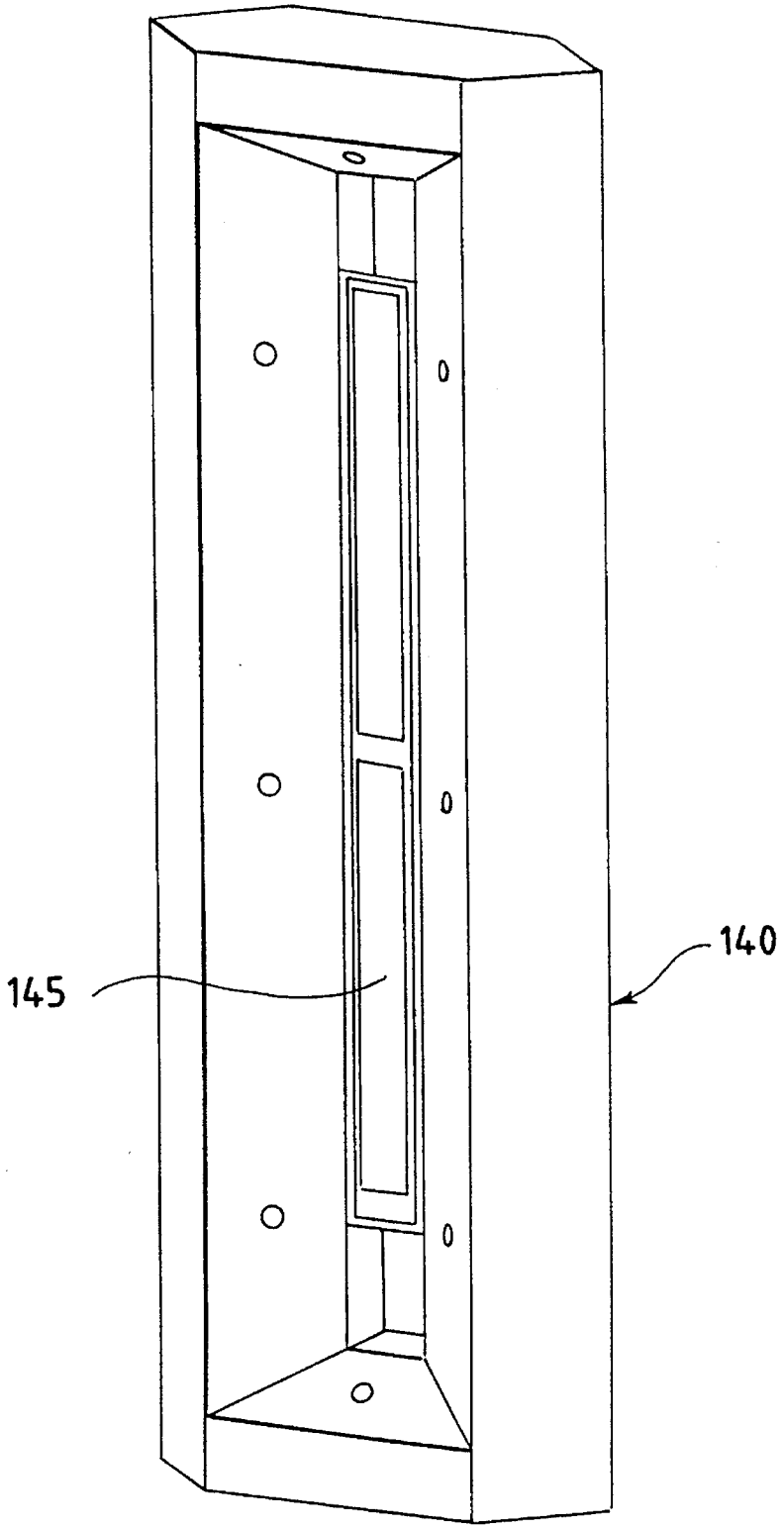
FIG. 21 is a perspective view of a corner module of the present invention, enclosing a window.
Figure 22:
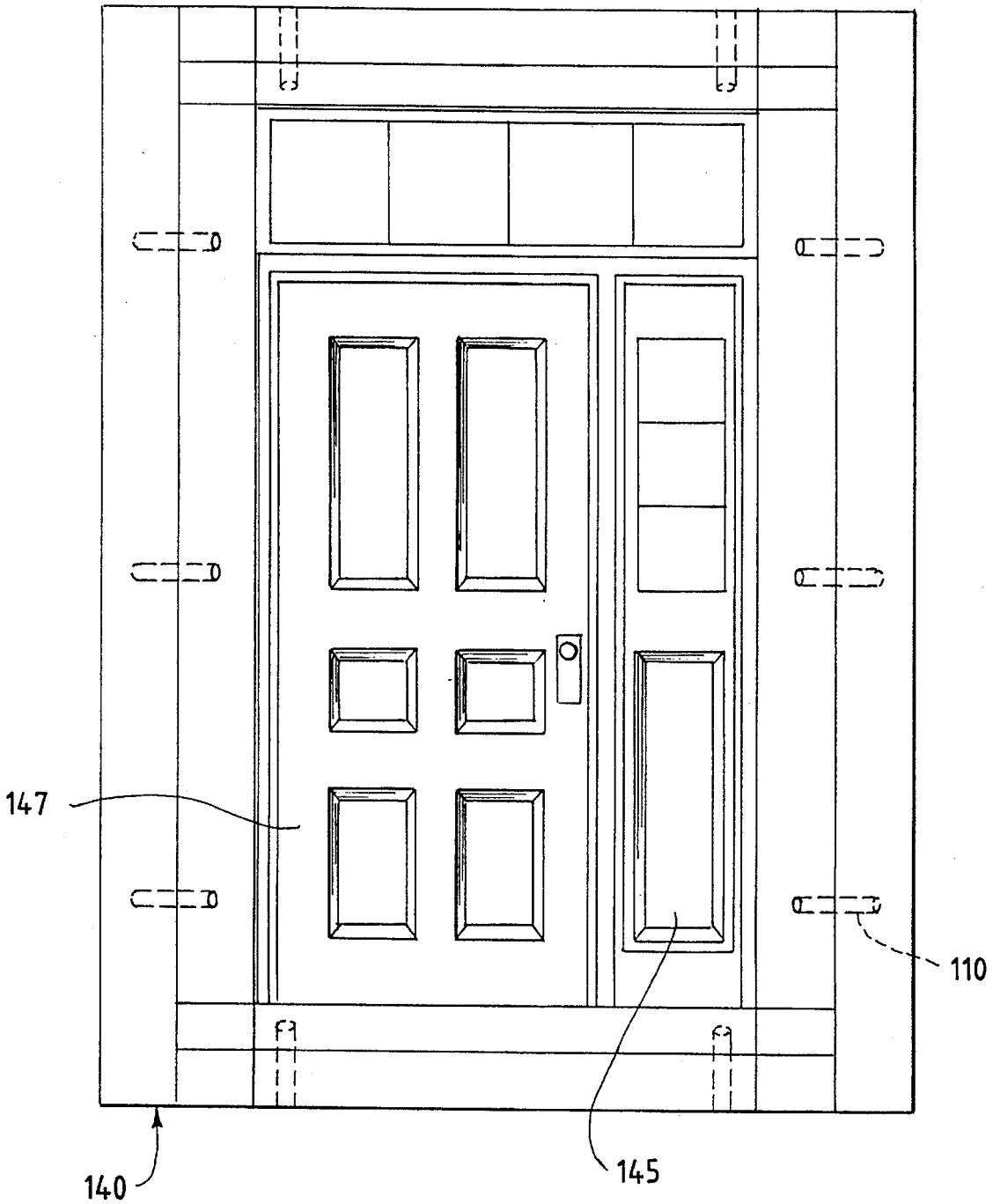
FIG. 22 is a perspective view of another embodiment of the module of the present invention, enclosing a door.
Figure 23:
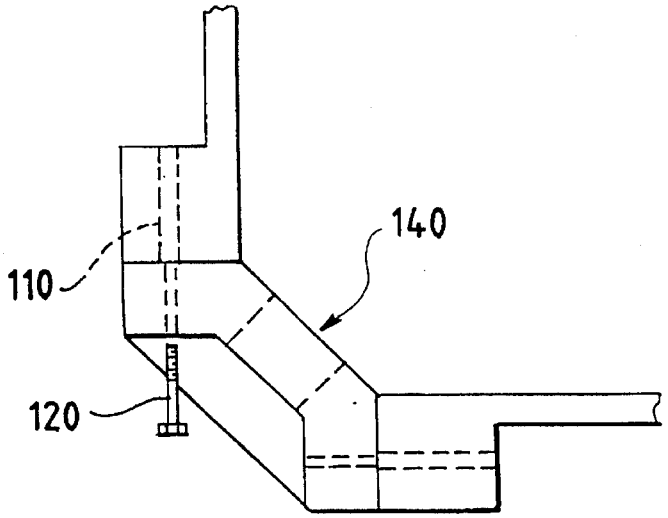
FIG. 23 is a top view of another embodiment of the present invention, employing a (hexagonal) U-shaped corner section, attached to portions of adjacent wall modules.
Figure 24:
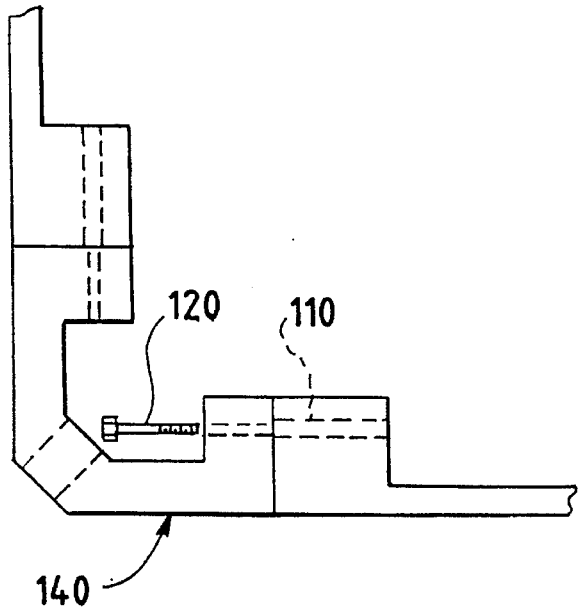
FIG. 24 is a top view of another embodiment of the present invention, employing a (hexagonal or pentagonal) corner section, attached to portions of adjacent wall modules.

Pre-cast concrete corner sections 140 (see FIGS. 9–12) can be attached by any conventional means, such as bolting, to corner wall modules 150. These corner sections may also include spaces for doors or windows, as shown in FIGS. 11 and 12, respectively. As another example (not shown in the drawings), a pre-cast concrete corner door section can be vertically bolted to a pre-cast concrete corner window section. In still other embodiments, a window 145 (FIG. 21) or a door 147 (FIG. 22) can be provided within a corner module 140. Also, as shown in FIGS. 23 and 24, corner sections with various geometrical configurations can be provided.

Figure 14:
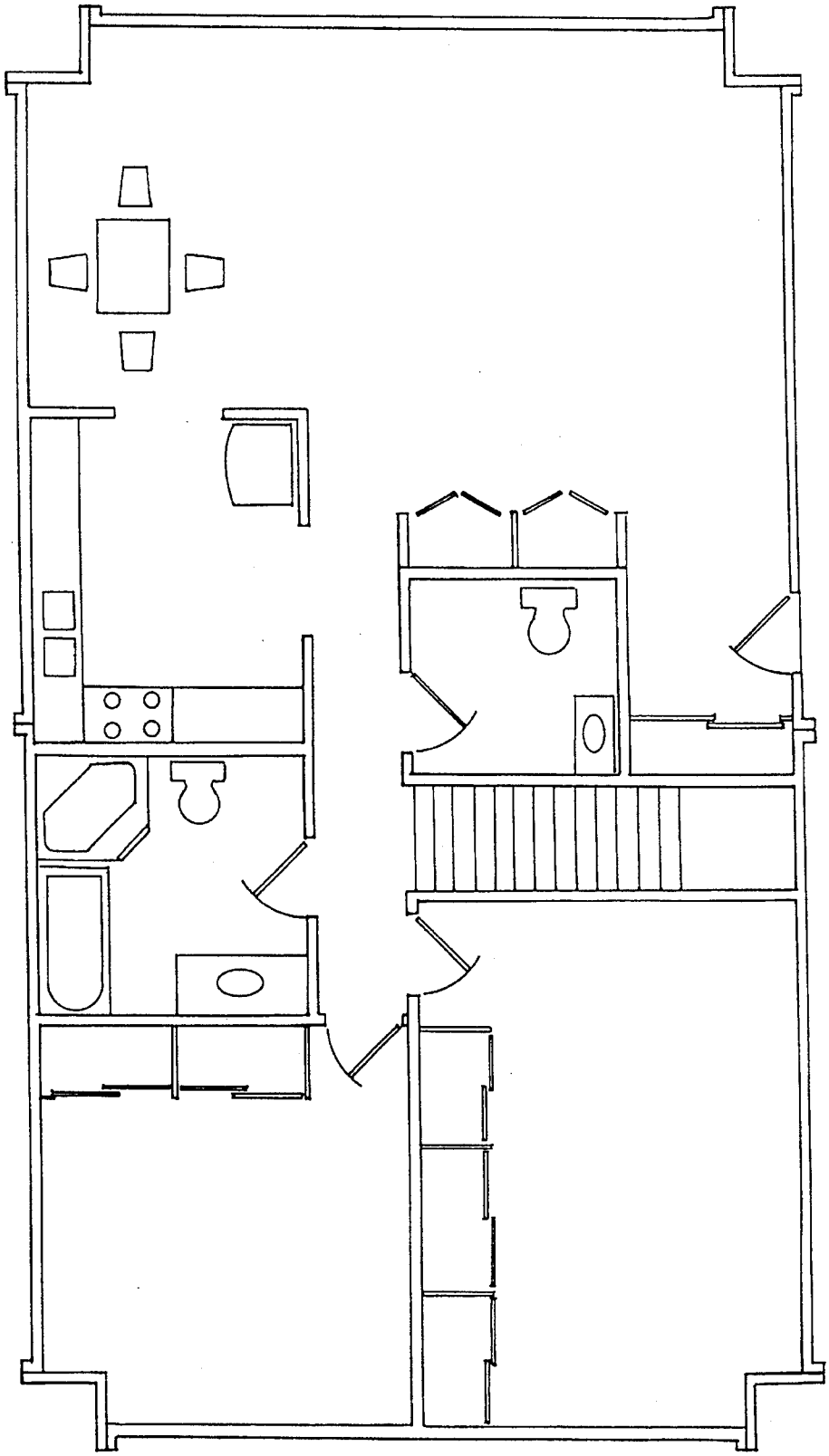
FIGS. 14–15 are alternative planar views of the first floor of a structure incorporating the wall modules of the present invention, having different corner section geometries.
Figure 15:
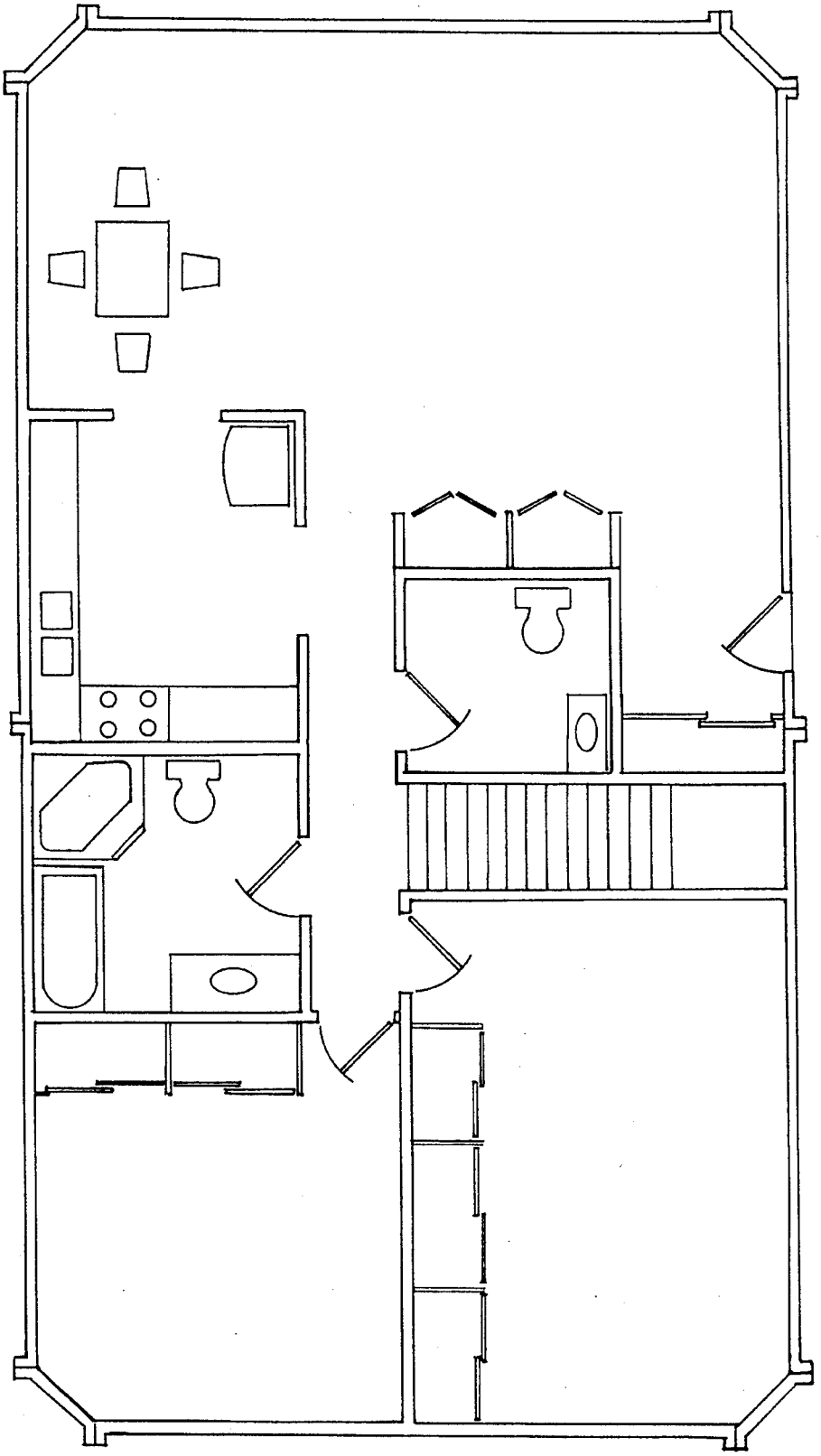

Examples of building structures employing corner sections with different geometries which can result from the teachings of this invention are shown at FIGS. 14–15. The U-shaped corner sections shown in FIGS. 5 and 10 are preferred, since they are easily bolted to the wall modules and become a self-supporting structure which need not be supported by whalers or the like.

Figure 16:
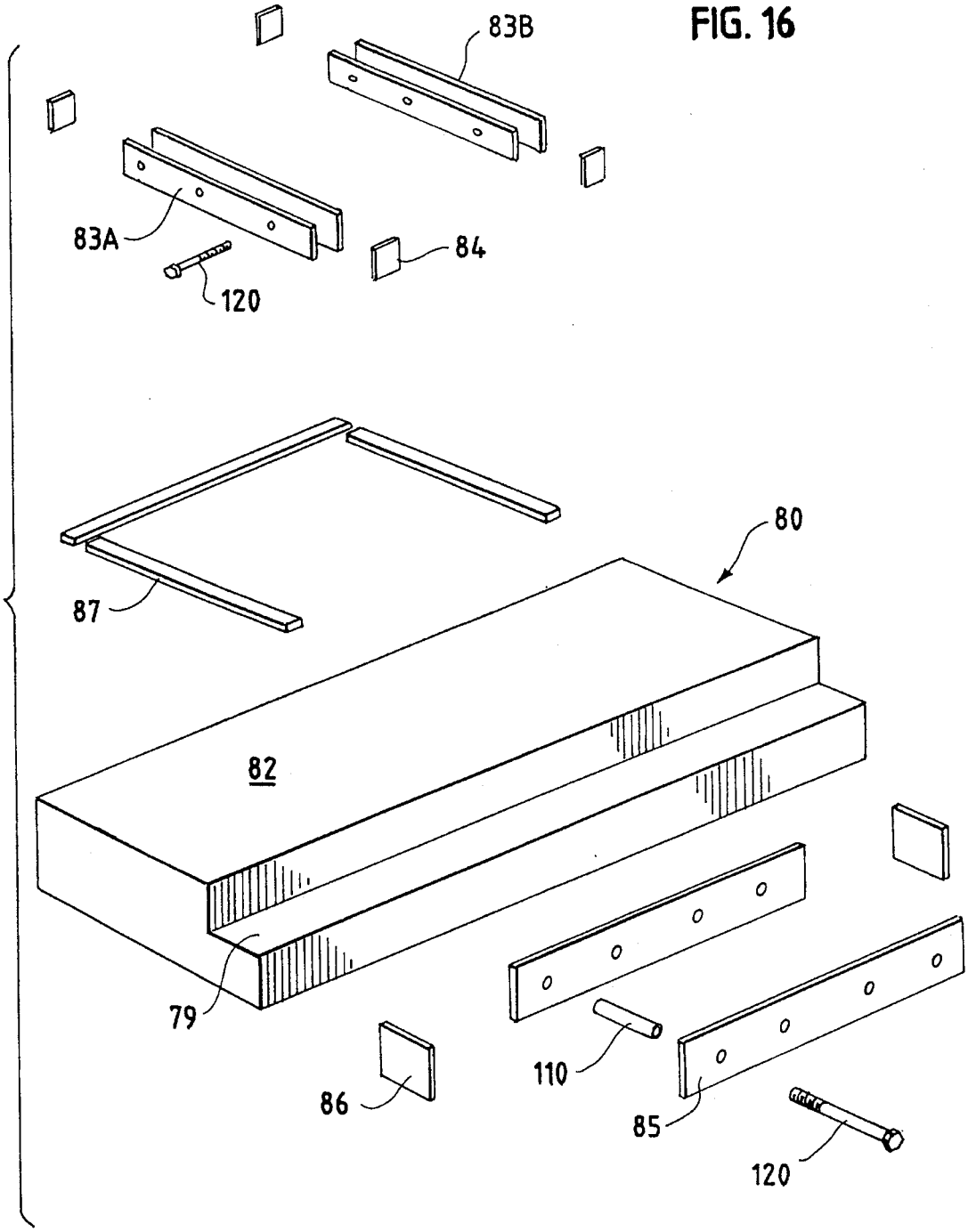
FIG. 16 is a side perspective view of the adjustable casting bed and edge forms assembly of the present invention.
Figure 17:
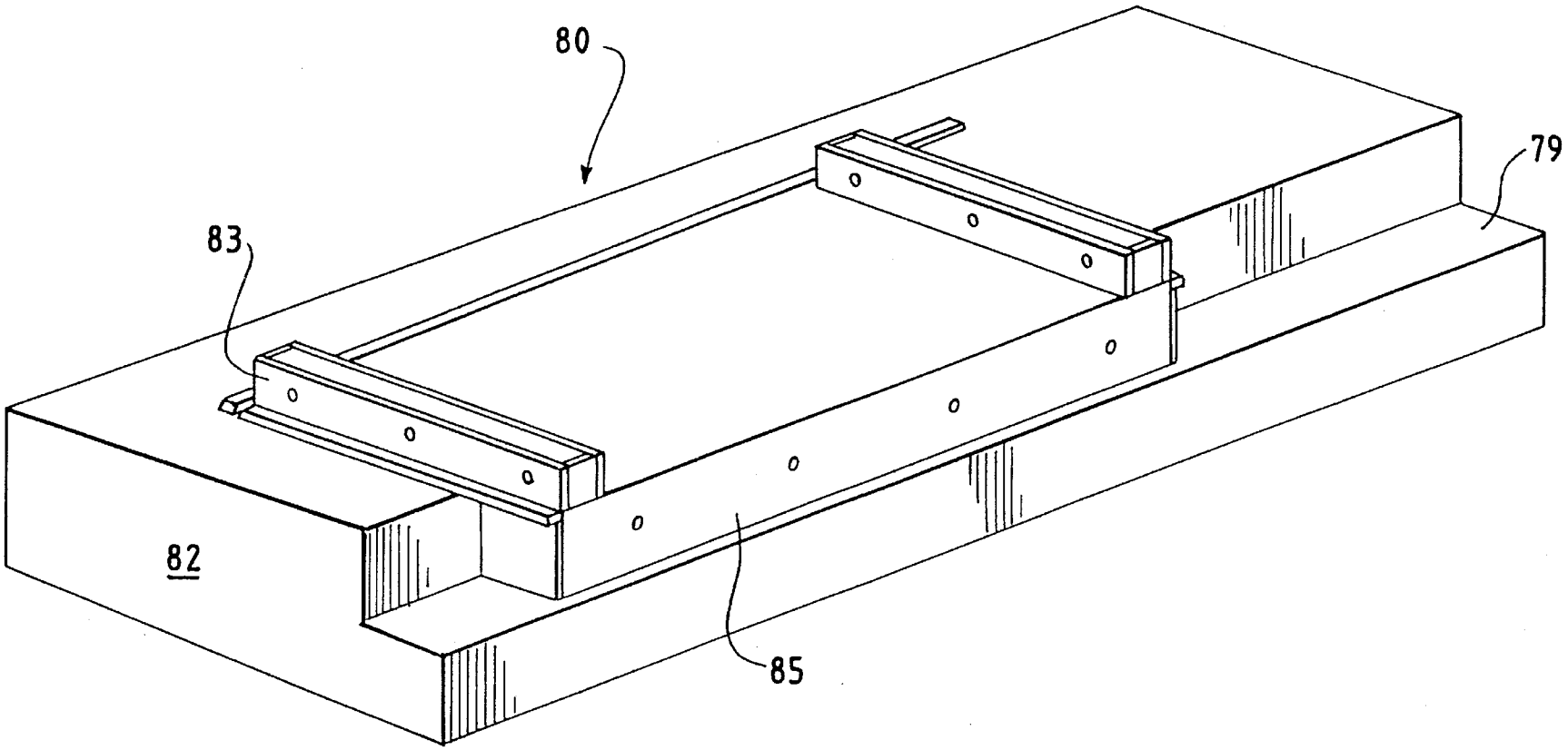
FIG. 17 is a side perspective view of a constructed casting bed housing a form assembly ready for casting.

Turning to FIGS. 16–17, a casting bed, generally designated as 80, is shown. Casting bed 80 includes a stepped slab 82 having a step down 79. Stepped slab 82 can be formed of concrete or steel (to better ensure dimensional uniformity). Instead of a single slab, lower and upper slabs can be used, with the lower slab being of greater area to form the step. Stepped slab 82 can be formed by any expedient means; in fact, a modified roadway portion or pavement can be used to form the required stepped slab.

FIGS. 16–17 also illustrate the edge form assembly modules, which consist of column edge forms 83A and 83B, column form ends 84, beam edge forms 85, beam form ends 86, and web forms 87. Once these edge forms and ends are appropriately sized (based on the desired size of the wall module 10), the edge forms and ends can be assembled on slab 82, using any convenient means of attachment. Once again, coil ties or rigid sleeves 110 and coil bolts 120 can be used to secure column edge forms 83A and 83B to each other, and column form ends 84 thereto. The beam edge forms 85 and beam form ends 86 can be similarly secured. After curing of the concrete, the edge forms are removed, leaving the embedded coil ties and corresponding receptacles for placement of bolts. These same coil ties are then used with coil bolts to connect adjacent wall modules, as discussed above.

The edge form assembly, as constructed for use in forming a pre-cast concrete panel, is shown in FIG. 17. It should now be apparent that the edge form assembly modules can be inexpensively deployed in different lengths over a wide range, so that wall modules 10 of a variety of sizes can be provided. The edge form assembly modules can be made from readily available materials, including plastic, wood (e.g., 2-by-4s), aluminum or steel C-channels.

Use of casting bed 80 of the present invention allows relatively quick, inexpensive adjustment of the wall module dimensions to many commercially useable sizes. The low initial cost enabled by the present invention can be further decreased through the formation of wall modules on-site (e.g., by use of the pavement as a casting bed), or in a pre-casting factory.

Concrete is one of the most versatile materials available. However, the concrete mixture matrix requires careful consideration since the matrix is sensitive to temperature, humidity, the water-cement ratio, the size and uniformity of the aggregate, admixtures, wind (when it occurs during curing), changes in the cross-sectional area of the concrete structure to be formed, and the types of forms used. The use of a hydroscopic gel can help control some of the parameters which effect the matrix. The gel is added to the concrete matrix during the mixing process. This admixture will tend to somewhat congeal the free water in the concrete mix, so that the gelled water cannot evaporate. Evaporation through the curing concrete leaves capillary voids and creates concrete shrinkage.

The preferred gel is manufactured by Specco Industries in Lemont, Ill., and is known as "SPECCO Original #19 For Concrete" or "Product #19". Product #19 reduces evaporation (evaporation out of the wet concrete leaves capillary voids in the matrix) and shrinkage. It is described as a neutral, thick, biodegradable chemical additive in liquid form which is nonflammable, noncorrosive and nontoxic, and can be used as a direct or partial replacment to lime. The gel is advertised in Specco's commercial literature as adding a lubricating effect to the concrete mix, increasing bond strength and freeze-thaw resistance, trapping the entrained air, and reducing bleeding, shrinkage, cracks, efflorescence and segregation of aggregates.

Today, pre-cast face-up concrete slabs can be finished in a wide variety of textures and patterns. For example, the concrete texture can vary from broom to slick to exposed agreggate. A wide variety of patterns are also avaiable, including patterns that will simulate the look of brick, wood or other designs. There are also methods available to rapidly imprint the exposed side of the slab with different patterns.

The unitary, integrated construction of each wall module 10, with its interconnected columns and beam, together with the interconnection of the structure as a whole (i.e., the connection of adjacent wall modules, and of each wall module to the foundation), enables the assembled structure to withstand forces (e.g., gale winds or hurricanes) which might otherwise tend to bend and crack the web. The structural steel is placed in the three-dimensional form of wall modules 10, allowing resistance to external loads from any direction.

Figure 18:
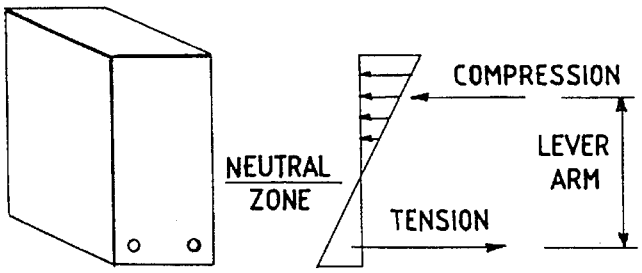
FIG. 18 is a perspective view of a reinforced deep beam section, together with a corresponding diagram showing the balanced distribution of stresses within the cross-section of the beam.
Figure 19:
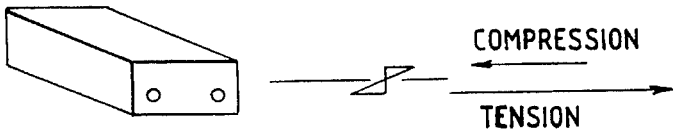
FIG. 19 is a perspective view of a reinforced shallow beam section, together with a corresponding diagram showing the unbalanced distribution of stresses within the cross-section of the beam.
Figure 20:
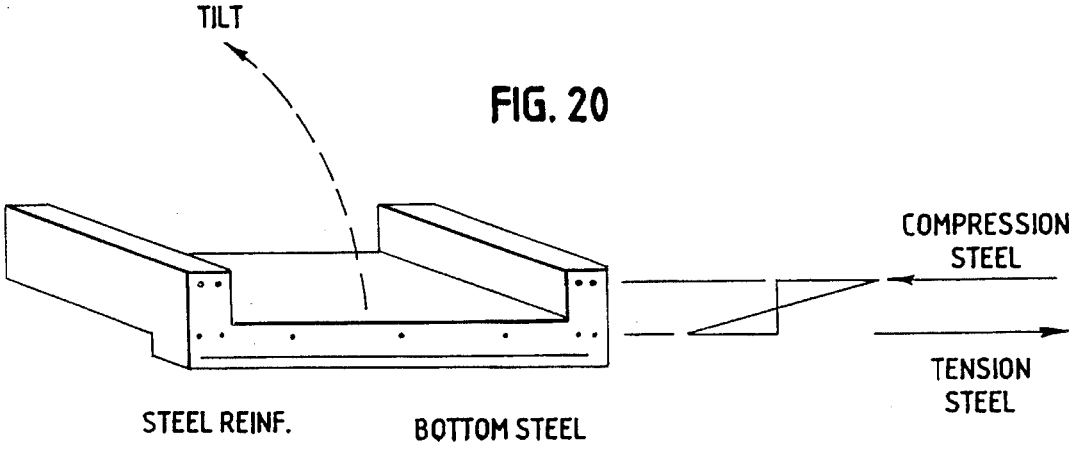
FIG. 20 is a end perspective view of a wall module of the present invention, together with a corresponding diagram showing the balanced distribution of stresses within the cross-section of the wall module.

Turning to FIGS. 18–20, a reinforced deep beam (FIG. 18), a reinforced shallow beam (FIG. 19), and the wall module 10 of the present invention (FIG. 20) are shown, together with the distribution of compressive and tensile stresses for each cross-section. As can be seen, the stresses on the beam fibers at the neutral zone are zero, and increase in magnitude to maximum values at the upper and lower surfaces. As can also be seen, the neutral zone for the deep and shallow beams is off-center from the beams, due to the presence of steel rebar. FIG. 19 illustrates that, for the shallow beam section shown, the steel reinforcing is too close to the neutral zone of stress, and is therefore not effective to prevent bending and cracking of the concrete during the lifting operation.

Once the panels have been erected, the reinforcing steel in the columns of an individual wall module 10 will be in compression. However, during tilt-up (see FIG. 20), the bottom steel (i.e., the steel in the beam) will be in tension, and the top steel (i.e., the steel in the columns) will be in compression. In order to minimize the bending of the wall module during the tilt-up operation, the top and bottom reinforcing steel should be in structural balance, in order to contain the stresses within their elastic limits. Containing the stresses within their "elastic limits" means that the stresses which the steel and concrete undergoes should not exceed the elastic properties of those materials. In other words, "elastic" means that when pressure is applied, the material will bend, and when the pressure is removed, the material will return to its original shape.

Therefore, if the reinforcing steel in the columns and beam is in structural balance, the tendency of the pre-cast concrete to crack (since concrete is not effective in tension) during lifting or later loading will be minimized. Those of ordinary skill will recognize that the load distribution for such an individual wall module 10, whether due to loads resulting from horizontal or vertical forces, will be carried in a relatively high percentage by the beam and columns. Such persons will also understand that it is likely that the most stressful condition which the concrete member will undergo during its lifetime is during lifting, due to the weight and freshness of the concrete. It is this most stressful condition which should set the design strength parameters of the wall modules.

It should be understood that various changes and modifications to the illustrated preferred embodiment will be apparent to those skilled in the art. Such changes and modifications can be made without departing from the spirit and scope of the present invention and without diminishing its intended advantages. It is, therefore, intended that such changes and modifications be covered by the following claims.

I claim:

1. Integrated precast concrete wall modules designed to be lifted into place and attached to form a structure having an interior adjacent an inner working or living space and an outer exterior, each wall module comprising:

a web having inner and outer web surfaces defining a web thickness, opposing lateral edges, and opposing top and bottom edges, with the inner web surface being adapted to be located adjacent the interior surface of the structure;

at least two vertically extending columns associated with the web to enhance the ability of the web to resist bending, each column being positioned adjacent one of the lateral edges of the web, and each column also having inner and outer column surfaces defining a column thickness, with the column thickness being substantially greater than the web thickness, the inner column surface being substantially coplanar with the inner web surface, and the outer column surface projecting in a transverse direction outwardly beyond the outer web surface; and a beam being unitary constructed with the web and columns, the beam providing rigidity to the web and strengthening the web against web failure during lifting of the module, the beam being positioned adjacent the top edge of the web and having an the inner beam surface located adjacent the interior of the structure and projecting beyond the inner web and inner column surfaces, and an upper surface of the beam being substantially coplanar with an upper surface of the columns and thereby forming a uniform upper surface of the wall module, whereby the resulting wall module can be lifted or tilted into place without structural cracking, and then attached to other wall modules to form the structure.

2. The integrated precast concrete wall modules of claim 1, wherein the web of each wall module has a slenderness ratio which is less than 120.

3. The integrated precast concrete wall modules of claim 1, wherein the web thickness of each wall module is less than 4 inches.

4. The integrated precast concrete wall modules of claim 1, each wall module further comprising at least one intermediate column positioned in an intermediate location along the web and between the two columns.

5. The integrated precast concrete wall modules of claim 1, each wall module further comprising reinforcing members positioned inside the wall module, whereby the stresses within the wall module are confined within the elastic limit of the wall module during lifting and normal loading conditions.

6. The precast concrete forming system of claim 9, wherein the beam of each module is positioned outside of the interior space.

7. The integrated precast concrete wall modules of claim 1, wherein the inner surface of the web is insulated.

8. The integrated precast concrete wall modules of claim 1, wherein each module is comprised of a concrete mixture which includes a hygroscopic gel to reduce shrinkage by retarding evaporation.

9. The integrated precast concrete wall modules of claim 1, each module further comprising insulation associated with the inner surface of the beam.

10. A precast concrete forming system for fabricating a structure having interior and exterior surfaces, comprising:

a plurality of precast concrete modules joined together to form at least a part of the structure, each module including:

(a) a relatively thin web with inner and outer surfaces defining a web thickness, opposing lateral edges, and opposing top and bottom edges, the inner web surface being defining the interior surface of the structure;

(b) at least two vertical columns, each column being positioned adjacent one of the lateral edges of the web and enhancing the ability of the web to resist bending, each column also having inner and outer column surfaces defining a column thickness substantially greater than the web thickness, and the outer column surface extending beyond the outer web surface;

(c) at least one horizontal beam located adjacent the top edge of the web and strengthening the web against web failure during lifting of the module, the beam being integrally constructed with the columns and extending in its horizontal direction generally perpendicular to the columns, an upper surface of the beam being substantially coplanar with upper surfaces of the columns and the web thereby forming a uniform upper surface for each wall module, and the beam in a direction transverse to its length projecting inwardly beyond the inner surface of the web; and (d) connecting members for attaching adjacent modules to each other, whereby the resulting wall module can be lifted or tilted into place without structural cracking, and then attached to other wall modules to form the structure.

11. The precast concrete forming system of claim 10, wherein the modules are attached to other structures using said connecting members.

12. The precast concrete forming system of claim 10, further comprising reinforcing members for placement in the modules and for interconnecting the web, columns and beam of each module to enhance its strength.

13. The precast concrete forming system of claim 12, wherein the reinforcing members are placed in each module in a manner providing structural balance, so as to minimize the bending of each module during tilting and erection.

14. The integrated pre-cast concrete forming system of claim 11, wherein said connecting members include coil ties and corresponding coil bolts.

* * * * *

UNITED STATES PATENT AND TRADEMARK OFFICE

CERTIFICATE OF CORRECTION

PATENT NO. : 5,566,520
DATED : 10/22/1996
INVENTOR(S) : Abraham Brantizky

It is certified that error appears in the above-indentified patent and that said Letters Patent is hereby corrected as shown below:

In the claims, column 8, line 26 delete the 2nd "the"

Signed and Sealed this

Twenty-ninth Day of April, 1997

*Attest:*

*Attesting Officer*

Bruce Lehman

BRUCE LEHMAN

*Commissioner of Patents and Trademarks*